US011396807B2

(12) United States Patent
Dugas

(10) Patent No.: US 11,396,807 B2
(45) Date of Patent: Jul. 26, 2022

(54) DUAL TURBINE POWER AND WELLBORE COMMUNICATIONS APPARATUS

(71) Applicant: Bryan Dugas, Breaux Bridge, LA (US)

(72) Inventor: Bryan Dugas, Breaux Bridge, LA (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/881,555

(22) Filed: May 22, 2020

(65) Prior Publication Data

US 2020/0370426 A1 Nov. 26, 2020

Related U.S. Application Data

(60) Provisional application No. 62/851,457, filed on May 22, 2019.

(51) Int. Cl.

| | |
|---|---|
| ***E21B 47/18*** | (2012.01) |
| ***E21B 41/00*** | (2006.01) |
| ***E21B 47/00*** | (2012.01) |
| *E21B 21/08* | (2006.01) |
| *E21B 21/10* | (2006.01) |

(52) U.S. Cl.

CPC ..... *E21B 47/18* (2013.01); *E21B 41/0085* (2013.01); *E21B 47/00* (2013.01); *E21B 21/08* (2013.01); *E21B 21/103* (2013.01); *E21B 2200/06* (2020.05)

(58) Field of Classification Search

CPC ..... E21B 47/18; E21B 47/00; E21B 41/0085; E21B 2200/06; E21B 21/08; E21B 21/103

See application file for complete search history.

(56) References Cited

U.S. PATENT DOCUMENTS

| | | | | |
|---|---|---|---|---|
| 3,958,217 A | | 5/1976 | Spinnler | |
| 5,295,548 A | | 3/1994 | Yuasa et al. | |
| 5,626,200 A | * | 5/1997 | Gilbert | E21B 41/0085 175/40 |
| 5,969,430 A | | 10/1999 | Forrey | |

(Continued)

OTHER PUBLICATIONS

International Search Report and Written Opinion for International Application No. PCT/US2020/034161; International Filing Date May 22, 2020; dated Sep. 1, 2020; 8 Pages.

(Continued)

*Primary Examiner* — Brad Harcourt
(74) *Attorney, Agent, or Firm* — Cantor Colburn LLP

(57) ABSTRACT

A downhole system and method of performing an operational action with the downhole system. The downhole system includes a downhole string having a flow channel therethrough, a first turbine generator for generating electrical energy when a flow rate of a fluid through the flow channel is within a first flow rate range, and a second turbine generator for generating electrical energy when a flow rate of the fluid through the flow channel is within a second flow rate range. A first pulser at a downhole location in the downhole string transmits a pressure pulse communicative of data generated downhole using electrical energy generated by one of the first turbine generator and the second turbine generator. A sensor at a surface location receives the pressure pulse, and a control unit performs the operational action based on the data communicated by the pressure pulse.

19 Claims, 7 Drawing Sheets

(56) References Cited

U.S. PATENT DOCUMENTS

| | | | | |
|---|---|---|---|---|
| 6,050,349 | A | 4/2000 | Rountree et al. | |
| 6,210,105 | B1 | 4/2001 | Irish | |
| 6,469,637 | B1 | 10/2002 | Seyler et al. | |
| 6,909,667 | B2 | 6/2005 | Shah et al. | |
| 7,102,379 | B2 | 9/2006 | Hobelsberger et al. | |
| 7,325,606 | B1 | 2/2008 | Vail, III et al. | |
| 8,502,696 | B2 | 8/2013 | Clark | |
| 9,291,049 | B2 | 3/2016 | Switzer et al. | |
| 9,677,384 | B2 * | 6/2017 | Delgado | E21B 41/0085 |
| 9,702,245 | B1 | 7/2017 | Dugas | |
| 9,866,063 | B2 | 1/2018 | Hough | |
| 2011/0011594 | A1 | 1/2011 | Young et al. | |
| 2013/0222149 | A1 | 8/2013 | Li et al. | |
| 2014/0027175 | A1 | 1/2014 | Ringer et al. | |
| 2016/0145975 | A1 * | 5/2016 | Carroll | H02K 7/1823 166/244.1 |
| 2016/0319656 | A1 | 11/2016 | Downie | |
| 2017/0362953 | A1 * | 12/2017 | Gatzen | H02K 1/2786 |
| 2018/0230800 | A1 | 8/2018 | Turner | |
| 2020/0056458 | A1 * | 2/2020 | Mao | H02K 11/0094 |
| 2021/0095546 | A1 * | 4/2021 | Angman | E21B 17/1078 |
| 2021/0102444 | A1 * | 4/2021 | Chen | F03B 13/02 |

OTHER PUBLICATIONS

IPCOM000244900; A Robust Mud Pulse Telemetry System for Error Prone Mud Channel, Abstract, Publication Date: Jan. 27, 2016, https://priorart.ip.com/IPCOM/000244900, Abstract, 2 pages.

Nygaard; "Evaluation of Measurement-While-Drilling, telemetry methods and integration of control systems", https://brage.bibsys.no/xmlui/bitstream/handle/11250/183444/Evaluation%20of%20Measurement-While-Drilling%2C%20Telemetry%20Methods%20and%20Integration%20of%20Control%20Systems.pdf?sequence=1&isAllowed=y, pp. 1-77.

* cited by examiner

DUAL TURBINE POWER AND WELLBORE COMMUNICATIONS APPARATUS

CROSS REFERENCE TO RELATED APPLICATIONS

This application claims the benefit of an earlier filing date from U.S. Provisional Application Ser. No. 62/851,457, filed May 22, 2019, the entire disclosure of which is incorporated herein by reference.

BACKGROUND

In the resource recovery industry, a drill string is used to drill a wellbore in a formation. A drilling fluid or drilling mud is sent downhole through an inner bore of the drill string to exit the drill string at a drill bit located at a bottom end of the drill string. The drilling fluid then travels uphole, carrying rock cuttings uphole to a surface location, thereby cleaning the drilling area and wellbore of cuttings. The drill string can also include a turbine generator that is powered by the flow of the drilling fluid through the drill string. The turbine generator generally operates within a specified operating flow rate range of flow rates. Power from the turbine generator can be used to operate downhole devices and/or communication or telemetry systems that allow communication between a downhole device of the drill string and various devices at a surface location. Flow rates can vary widely and generators and turbines may be adversely affected when the flow rate becomes excessively high. For example, at high flow rates the increased rotational rate produces high torques within the generator or turbine. In addition, at high flow rates, more power can be generated than is necessary for the intended application, thereby leading to heat production.

Abnormal drilling situations or well control events, such as lost circulation events due to fluid leakage into the formation or circulation blockage, can sometimes occur. During such an event, the flow rate of the drilling fluid is reduced in order to prevent exacerbating the situation and to allow for remedial action to be taken. With the drilling fluid flowing at flow rates below the operating flow rate range of the turbine generator, no data can be communicated to the surface. Therefore, remedial operations are generally run without useful feedback from downhole devices. In addition, once the remedial operation is completed, additional time is lost in order to perform post-run analyses. Thus, there is a need to be able to power downhole communication devices during a lost circulation event.

SUMMARY

A method of performing an operational action with a downhole system is disclosed, the method including: conveying a downhole string of the downhole system into a wellbore, flowing a fluid through the downhole string at a first flow rate within a first flow rate range, generating electrical energy using a first turbine generator configured to generate electrical energy when the flow rate is within the first flow rate range, flowing the fluid at a second flow rate within a second flow rate range, generating electrical energy using a second turbine generator configured to generate electrical energy when the flow rate is within a second flow rate range different than the first flow rate range, transmitting a pressure pulse communicative of data generated downhole using a first pulser powered by one of the first turbine generator and second turbine generator, receiving the pressure pulse at a sensor at a surface location, and performing an operational action based on the data communicated by the pressure pulses.

A downhole system is disclosed, the downhole system including: a downhole string having a flow channel therethrough, a first turbine generator configured to generate electrical energy when a flow rate of a fluid through the flow channel is within a first flow rate range, a second turbine generator configured to generate electrical energy when a flow rate of the fluid through the flow channel is within a second flow rate range, a first pulser at a downhole location in the downhole string, the first pulser operable to transmit a pressure pulse communicative of data generated downhole, using electrical energy generated by one of the first turbine generator and the second turbine generator, a sensor at a surface location receptive to the pressure pulse; and a control unit configured to perform an operational action based on the data communicated by the pressure pulse.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
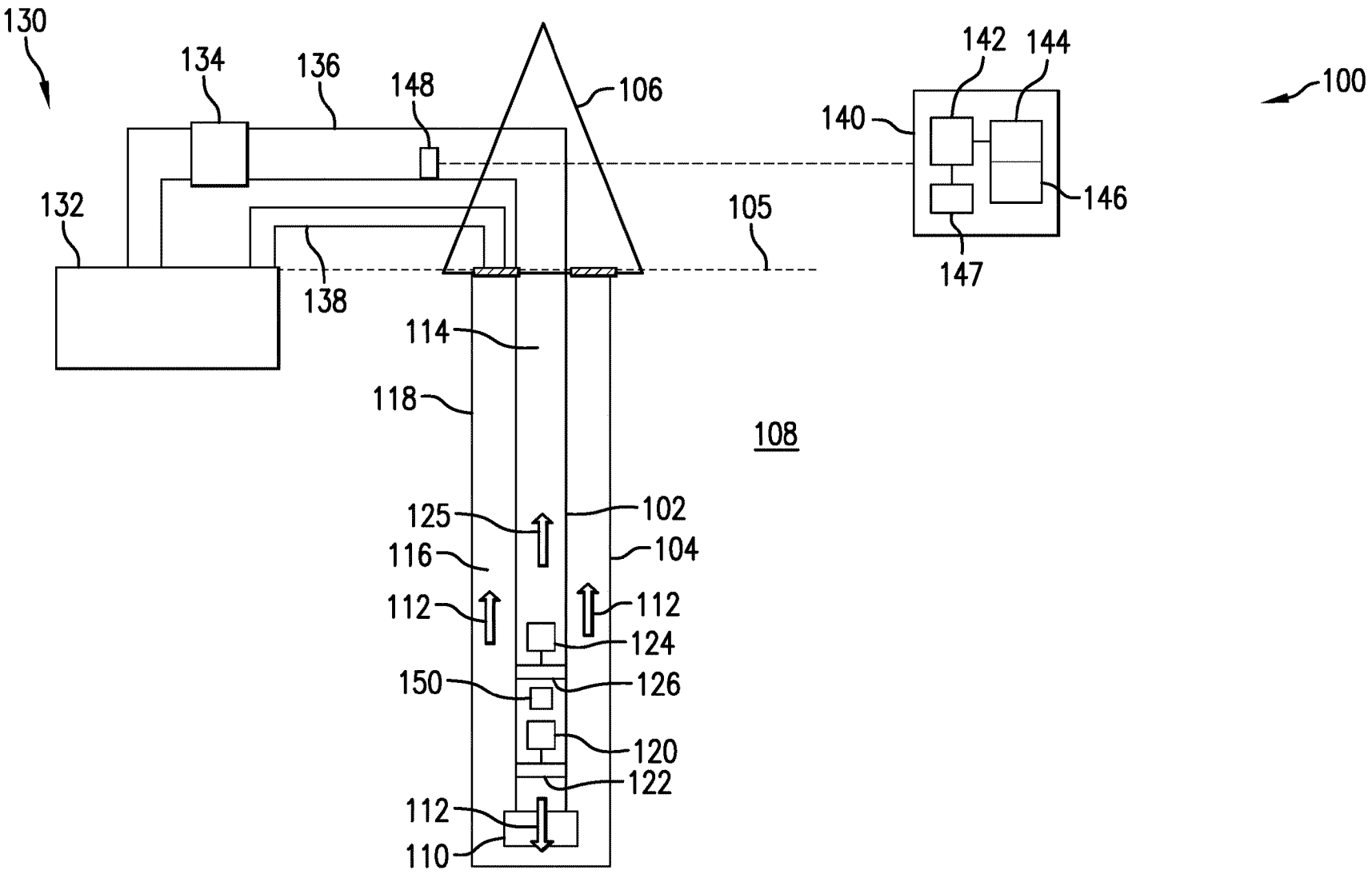
FIG. 1 shows an illustrative drilling system suitable for performing downhole operations during a lost circulation event.

Referring to FIG. 1, an illustrative drilling system 100 suitable for performing downhole operations during a lost circulation event is shown. The drilling system 100 includes a drilling rig 106 at a surface location 105. A drill string 102, also referred to herein as a downhole string, extends from the drilling rig 106 into a wellbore 104 penetrating a formation 108. A drill bit 110 at a bottom end of the drill string 102 drills the wellbore 104 through the formation 108.

A drilling fluid circulation system 130 is used to transport cuttings produced by the drill bit 110 to the surface location 105. The drilling fluid circulation system 130 includes a mud pit 132 at the surface location 105 for storing a drilling fluid 112, herein also referred to as drilling mud, mud, downhole fluid, or fluid. A standpipe 134 connects the mud pit 132 to a top of the drill string 102. A pump 136 in the standpipe 134 draws the drilling fluid 112 from the mud pit 132 and pumps the drilling fluid 112 downhole through an inner bore 114 of the drill string 102, also referred to as a flow channel. The drilling fluid 112 exits the bottom of the drill string 102 through the drill bit 110. The drilling fluid 112 then returns to the surface location 105 through an annulus 116 between the drill string 102 and a wall 118 of the wellbore 104. At the surface location 105, the drilling fluid 112 is returned to the mud pit 132 via a return line 138.

The standpipe 134 includes a pressure sensor 148 within its inner bore 114. The pressure sensor 148 measures a pressure pulse 125 generated in the drilling fluid 112 by one of a main pulser 120 (also referred to herein as a "second pulser") and an auxiliary pulser 124 (also referred to herein as a "first pulser") located downhole. In various embodiments, the pressure sensor 148 can be one of a plurality of pressure sensors. The pressure sensor 148 is in communication with a control unit 140, The control unit 140 includes a processor 142, a display 147 (monitor) and a memory storage device 144. The memory storage device 144 includes programs and instructions 146 that when accessed by the processor 142 cause the processor 142 to perform various actions disclosed herein. In particular, the processor 142 can control various downhole operations, also referred to as operational actions, such as a lost circulation materials (LCM) operation, during a lost circulation event such as loss of drilling fluid 112 into the formation 108, opening a fluid connection in the downhole string, such as a valve, or an operational action in case of a blockage of fluid circulation through the drill string 102, such as shutting down a pump. The memory storage device 144 is also used to store data received from a downhole location and transmitted by a downhole pulser. These data may be accelerometer data, temperature data, pressure data, bending data, formation evaluation (FE) data, such as nuclear data, acoustic data, resistivity data, nuclear magnetic resonance (NMR) data, or sampling data.

Mud flow rates can vary widely and downhole generators and turbines may be adversely affected when the flow rate becomes excessively high. For example, at high flow rates the increased rotational rate of the turbine, a drive shaft and a rotor of the generator produces high torques within a downhole generator or turbine. In addition, at high flow rates, more power can be generated than is necessary for the intended application, thereby leading to heat production. The drill string 102 includes the main pulser 120 for generating pressure pulses in the drilling fluid 112 during normal operations and an auxiliary pulser 124 for generating pressure pulses in the drilling fluid 112 during for example a lost circulation event in which flow rates are reduced. The pressure pulses are communicative of information (data) transmitted with the pressure pulses from a downhole location to a surface location (uplink). The main pulser 120 is located at a downhole location within the inner bore 114 of the drill string 102. When activated, the main pulser 120 generates a pressure pulse 125 that travels up hole through the drilling fluid 112 in the inner bore 114 to be detected by the sensor 148. The main pulser 120 is powered by a main turbine generator 122 (also referred to herein as a "second turbine generator"). located in the inner bore 114. A turbine generator is an electrical generator (or alternator) that is operatively coupled to a turbine wheel. The turbine transforms hydraulic power of a flowing fluid into rotational power of a rotating shaft (drive shaft). The turbine wheel transmits its mechanical energy via the rotating shaft to a rotor of the electrical generator, which houses magnets and coils. The generator may be a rotating AC generator or a rotating DC generator. The fluid flow causes the turbine wheel to rotate at a specific number of revolutions per minute (RPM). The rotating turbine wheel causes the generator to produce electrical power. The produced power depends on the RPM of the turbine wheel. The RPM of the turbine wheel depends on the flow rate of the fluid. The main turbine generator 122 has a wired electrical connection to the main pulser 120. In alternative embodiments the electrical connection from the main turbine generator to the main pulser includes a wireless electrical connection, such as an inductive connection, a capacitive connection, or magnetic resonance coupling. In various embodiments, the main pulser 120 and the main turbine generator 122 can be in a bottomhole assembly (BHA) of the drill string 102. During normal drilling operations, (i.e., operations in which the drilling fluid is flowing at or above a flow rate suitable for delivering rock cuttings from a bottom of the wellbore to the surface and for powering the whole BHA), the drilling fluid 112 causes the main turbine generator 122 to generate electrical energy that can be used by at least one downhole device 150 as well as to power the main pulser 120. The at least one downhole device 150 (tool) can include devices for obtaining various downhole measurements, such as annular temperature, annular pressure (pressure sensor in annulus), flow rate, inner bore pressure (pressure sensor in inner bore), fluid density, fluid viscosity, formation evaluation parameters (FE) such as acoustic data, nuclear data, resistivity data, nuclear magnetic resonance data, sampling data, gamma ray data, etc. The BHA may also includes devices for drilling the wellbore such as mud motor or a rotary steering unit. Devices in the BHA are coupled by electrical and/or optical couplers which run through wiring passages in a housing of the downhole devices in the BHA.

The auxiliary pulser 124 is powered by an auxiliary turbine generator 126 (also referred to herein as a "first turbine generator") located in the inner bore 114. The auxiliary turbine generator 126 has a wired electrical connection to the auxiliary pulser. In alternative embodiments the electrical connection from the auxiliary turbine generator to the auxiliary pulser includes a wireless electrical connection, such as an inductive connection, a capacitive connection, or magnetic resonance coupling. In various embodiments, the auxiliary pulser 124 is within the inner bore 114 of the drill string 102 at a location uphole of the main pulser 120 (i.e., further from the drill bit 110). In various embodiments, the main pulser and the main turbine generator 122, and the auxiliary pulser 124 and the auxiliary turbine generator 126 can be in the bottom hole assembly (BHA) of the drill string 102. Similarly, the auxiliary turbine generator 126 is within the inner bore 114 of the drill string 102 at a location uphole of the main turbine generator 122. The auxiliary turbine generator 126 is powered by the flow of the drilling fluid 112 through the inner bore 114 during lost circulation events. Flow rate ranges of operation of the main turbine generator 122 and the auxiliary turbine generator 126 are discussed below with respect to FIG. 2. The main turbine generator 122 and the auxiliary turbine generator 126 are located in the same inner bore of the drill string at different axial locations along a longitudinal axis L of the inner bore and the downhole system. In embodiments there may be only one inner bore (only one flow channel) in the downhole string. The auxiliary turbine is located uphole of the main turbine generator. The term uphole refers to a location closer to the surface location. The term downhole refers to a location farer way from the surface location or closer to a drill bit or the bottom end of the downhole string. The drive shaft connecting the turbine wheel and the rotor of the generator of the auxiliary turbine generator are located within the inner bore and is significantly parallel to the longitudinal axis of the downhole system and may be oriented coaxially with the drive shaft connecting the turbine wheel and the rotor of the main generator.

Figure 2:
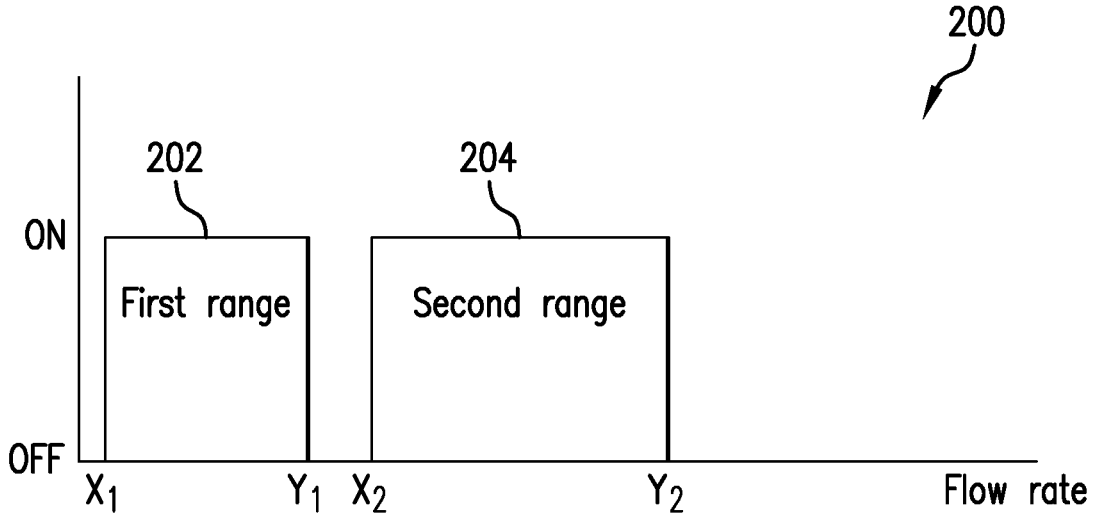
FIG. 2 shows a graph of operating flow rate ranges of a main turbine generator and auxiliary turbine generator within a drill string of the drilling system.

FIG. 2 shows a graph 200 of operating flow rate ranges of the main turbine generator 122 and auxiliary turbine generator 126. The auxiliary turbine generator 126 operates when fluid flow through it at a flow rate that is within a first flow rate range of flow rates 202. Specifically, the operating flow rate range of the auxiliary turbine generator 126 is within a flow rate range of flow rates bounded at its low end by a minimum flow rate $X_1$ and at its high end by a maximum flow rate $Y_1$, which are generally the operating specification of the auxiliary turbine generator 126. When the flow rate of the drilling fluid is outside of this first flow rate range of flow rates 202, the auxiliary turbine generator 126 shuts down and/or becomes dormant. To shut down a turbine generator, either the flow path needs to change to bypass the turbine wheel or a gear in the operational connection between the turbine wheel and the rotor of the alternator is shifted to allow the turbine wheel to run freely. Alternatively, a large energy consumer (such as a big resistor) may be connected to the alternator to dissipate excessive energy. When the flow falls below a minimum flow rate a turbine generator does not provide sufficient energy and is considered to be shut down or dormant During a lost circulation event, the drilling fluid 112 can be maintained to flow through the drill string 102 at a flow rate within this first flow rate range of flow rates 202. The auxiliary pulser and the main pulser are configured to create decodable pressure pulses in the first and second flow range, respectively. A decodable pressure pulse is a pressure pulse with a sufficient amplitude, clearly separated from an earlier and later pressure pulse with sufficient pulse rate (pulses per second). Sufficient amplitude relates to clear detectability of a pressure pulse at the pressure sensor 148 at the surface location. Sufficient data rate (bits per second (bps)) relates to data rates sufficient to transmit coded information by a digital pattern formed by pulse trains assembled from pulse and no-pulse events. The control unit 140 at the surface location is configured to decode the digital pattern into processable data or information. Sufficient data rate may be 1 to 2 bps, 1 to 5 bps, 1 to 8 bps, 1 to 12 bps, or 3 to 8 bps, 5 to 12 bps, 10 to 15 bps, 10 to 20 bps, 20 to 40 bps. A mud pulser may be a poppet valve pulser, a shear valve pulser, or a mud siren. Depending on the pulser type the digital pattern of the pressure pulses are more sophisticated, such as phase shift key (PSK), frequency shift key (FSK) or amplitude modulation (AM).

The main turbine generator 122 operates within a second flow rate range of flow rates 204. Specifically, the operating flow rate range of the main turbine generator 122 is within a flow rate range of flow rates bounded at its low end by a minimum flow rate value $X_2$ and at its high end by a maximum flow rate value $Y_2$, which are generally the operating specification of the main turbine generator 122. When the flow rate of the drilling fluid is outside of this second flow rate range of flow rates 204, the main turbine generator 122 shuts down and/or becomes dormant. The operating flow rate range of the main turbine generator 122 includes flow rates that are greater than the flow rates in the operating flow rate range of the auxiliary turbine generator 126. During standard drilling operations, the drilling fluid 112 flows through the drill string 102 within this first flow rate range of flow rates 202.

A possible flow rate range for the first flow rate range of flow rates 202 or operating flow rate range of the auxiliary turbine generator 126 can be from about 50 gallons per minute (gpm) to about 500 gpm. In another embodiment, the first flow rate range of flow rates is from about 70 gpm to about 400 gpm. In yet another embodiment, the first flow rate range of flow rates is from about 100 gpm to about 300 gpm. In yet another embodiment, the first flow rate range of flow rates is from about 120 gpm to about 200 gpm.

In one embodiment, the operating flow rate range of the auxiliary turbine generator 126 (i.e., the first flow rate range of flow rates 202) is less than the operating flow rate range of the main turbine generator 122 (i.e., the second flow rate range of flow rates 204). In other words, the maximum value $Y_1$ of the first flow rate range of flow rates 202 is less than the minimum value $X_2$ of the second flow rate range of flow rates 204. In alternate embodiments, the operating flow rate range of the auxiliary turbine generator 126 overlaps the operating flow rate range of the main turbine generator 122.

The main pulser 120 and the auxiliary pulser 124, in combination, provide a dual channel mud pulse transmission system, having two independent mud pulse channels. The main pulser 120 operates within a passband of data transmission frequencies while the auxiliary pulser 124 operates within a base band of data transmission frequencies. The main pulser 120 typically operates at a higher data rate (in bits/second) than the auxiliary pulser 124. Both pulsers may operate at the same time. The pressure pulses of the main pulser in the passband and the pressure pulses of the auxiliary pulser in the base band are detected at surface by a pressure sensor. The pressure pulses in the passband and pressure pulses in the baseband are separated based on their different transmission frequencies. Transmitting at two transmission frequencies (passband, baseband) allows for duplex transmission of two different mud channels and therefore higher data rates than transmission in only one band. In case the flow rate range 202 of the auxiliary turbine generator and the flow rate range 204 of the main turbine generator are overlapping, both pulsers, the auxiliary pulser and the main pulser are powered at the same time and can provide dual channel mud pulse transmission. In alternative embodiments one of the auxiliary pulser and the main pulser may be powered by a battery, if the flow ranges 202 and 204 are not overlapping and only the auxiliary turbine generator or the main turbine generator are providing power. The main pulser may be a shear valve pulser while the auxiliary pulser may be a poppet valve pulser.

Figure 3:
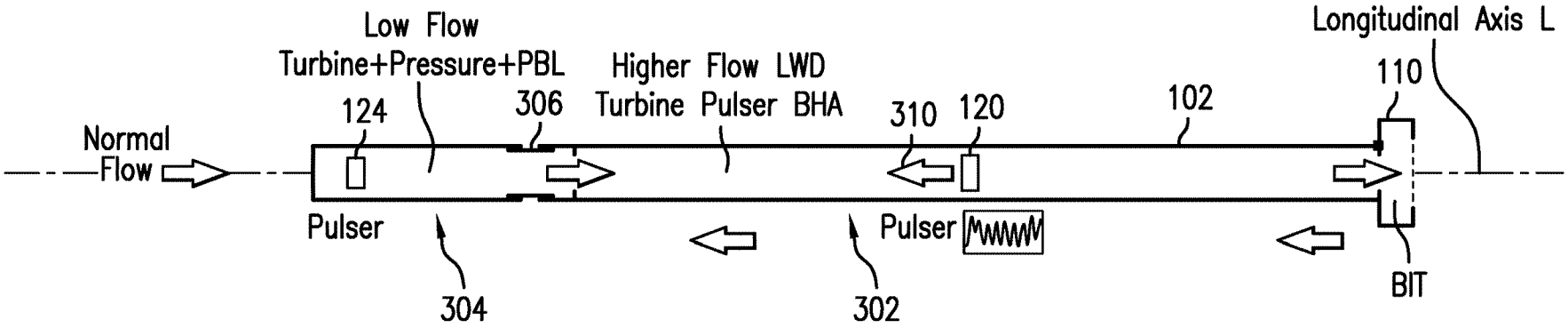
FIG. 3 shows an operation of the drill siring during a normal drilling operation.

FIG. 3 shows an operation of the drill string 102 during a normal drilling operation, i.e., with the drilling fluid flowing within the second flow rate range of flow rates 204. The drill string 102 includes a bottomhole assembly (BHA) 302 for performing various downhole operations and a sub 304 uphole of the BHA 302. The BHA 302 houses the main pulser 120 and its accompanying main turbine generator 122. The sub 304 houses the auxiliary pulser 124 and its accompanying auxiliary turbine generator 126. The sub 304 further includes a sliding sleeve 306 that can be moved to open one or more ports in the sub 304 to change a flow path of the drilling fluid 112, as illustrated in FIGS. 4A-4C and 5A-5B. In alternative embodiments the sub 304 may be part of the BHA. The sliding sleeve opens a fluid connection between the inner bore of the downhole string and the annulus between the downhole string and a wellbore wall. The fluid connection allows fluid to circulate between a surface location, the fluid connection in the downhole string provided by the sliding sleeve, the annulus and back to the surface location, without passing the lower part of the BHA and the drill bit 110. In alternative embodiments the sliding sleeve may be a valve. The sliding sleeve or the valve may be controlled by a downhole controller. The controller may receive information that leads the controller to open the fluid connection from the surface location (flow-on downlink or flow-off downlink) or the controller may open the fluid connection in an automated fashion based on a sensor reading of one of the downhole sensors 150, providing data about downhole pressure, temperature, formation properties or other operational parameter. The opening and the closing of the sliding sleeve or the valve may be facilitated by a sleeve or a valve actuator, respectively. The actuator may be hydraulic, pneumatic, electric, electro-hydraulic, piezoelectric, and electro-mechanical, in various embodiments.

Still referring to FIG. 3, with the drilling fluid 112 flowing in the second flow rate range of flow rates 204, the main turbine generator 122 generates power, while the auxiliary turbine generator 126 is dormant. Therefore, various devices 150, sensors, etc. of the BHA 302 operate using the power generated by the main turbine generator 122. The main pulser 120 is powered by main turbine generator 122 and generates pulse 310.

Figure 4A:
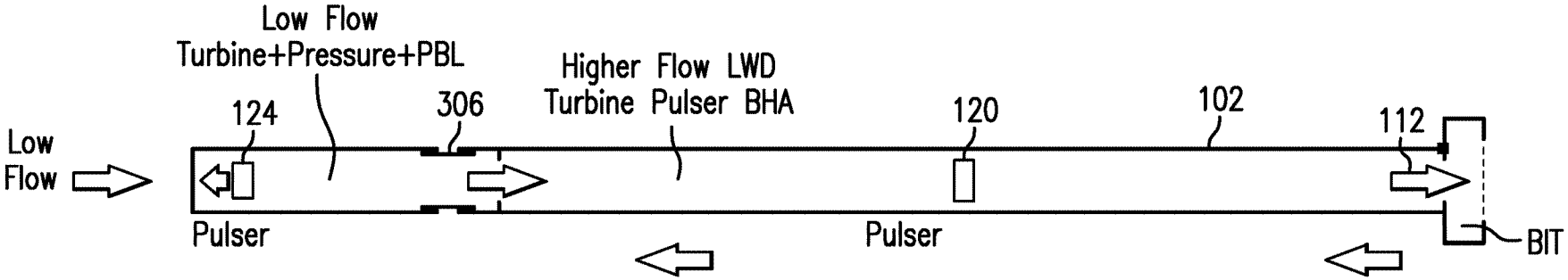
FIGS. 4A-4C illustrates various operations of the drill string during a lost circulation event.
Figure 4B:
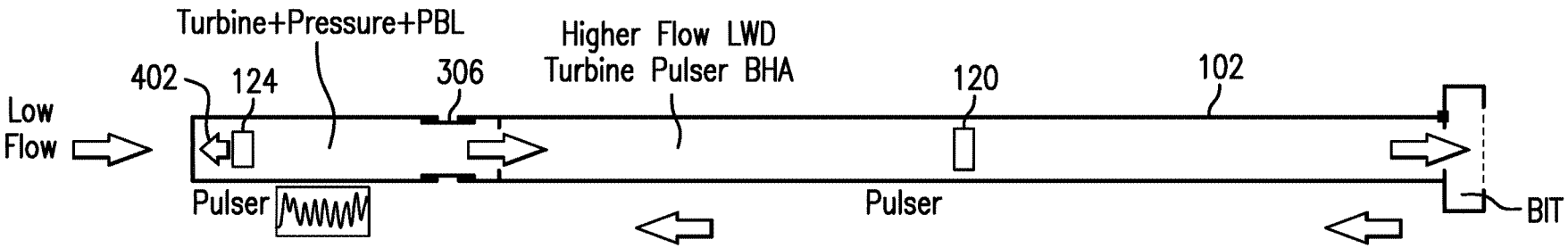
Figure 4C:
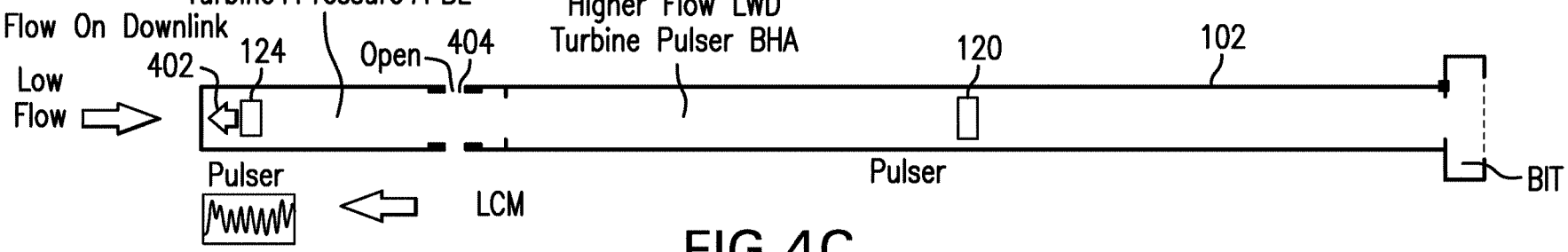

FIGS. 4A-4C illustrates various operations of the drill string 102 during a lost circulation event. In FIG. 4A, the flow rate of the drilling fluid 112 has dropped below the operating flow rate range of the main turbine generator 122 (i.e., below the value of $X_2$ in FIG. 2) due to a lost circulation event in which drilling fluid is lost into the formation. As the pressure of the drilling fluid drops due to fluid loss, the main turbine generator 122 is turned off while the auxiliary turbine generator 126 begins to operate, allowing for data transmission via the auxiliary pulser 124.

In FIG. 4B, the flow rate of the drilling fluid 112 is controlled from the surface to flow through the drill string 102 at a flow rate that is in the flow rate range of operation of the auxiliary turbine generator 126 (i.e., between the values $X_1$ and $Y_1$ in FIG. 2). During fluid losses, the flow rate of the drilling fluid is reduced to lower the frictional pressure on the formation in order to prevent additional losses. The power generated by the auxiliary turbine generator 126 is used to power downhole sensors and devices 150. Data obtained by these downhole devices 150 can be transmitted to the surface location 105 by pulse 402 created by the auxiliary pulser 124. During this time a lost circulation materials (LCM) can be circulated through the drill string 102 in order to exit at the drill bit 110.

FIG. 4C shows a lost circulation materials (LCM) operation in a lost circulation event. High concentrations of LCM are pumped into the wellbore in order to block leakages in the formation. The LCM can be pumped through the entire drill string 102 to exit at drill bit 110 as in FIG. 4B. FIG. 4C illustrates a diversion of fluid flow during the LCM delivery. Fluid modulation within the flow rate range of the auxiliary generator 126, a downlink, is used to activate a sliding sleeve 306 (shown in FIGS. 3, 4A and 4B) of sub 304, thereby moving sliding sleeve 306 to open one or more ports 404. With the ports 404 open, flow of the drilling fluid into the BHA 302 is closed off. The drilling fluid 112 thus flows out of the sub 304 through ports, delivering LCM uphole of the BHA 302 in the process. The flow rate of the drilling fluid is maintained within the operating flow rate range of the auxiliary turbine generator 126 in order to allow data communication using the auxiliary pulser 124 to create pulse 402 during the LCM operation. In the case of a well control situation, the flow of drilling fluid through the sub 304 can be stopped. The sliding sleeve 306 is spring loaded and will close the ports 404 due to the loss of drilling fluid pressure. In alternative embodiments another downlink is used to close the sliding sleeve. The downhole controller receives the downhole controller and sends a signal to the sleeve to close the sleeve. In alternative embodiments, a valve is used to open the one or more ports. The valve may be controlled by a valve actuator and the downhole controller.

Figure 5A:
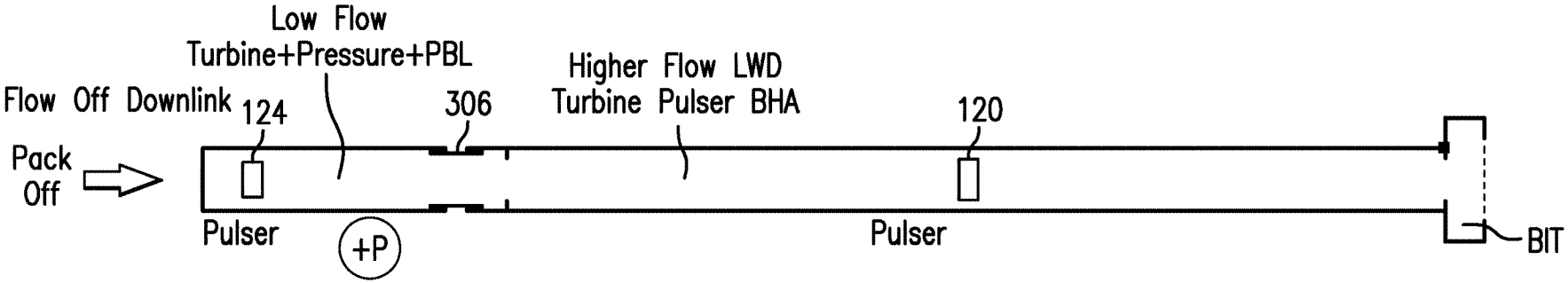
FIGS. 5A and 5B illustrate operation of the drill string during a circulation blockage.
Figure 5B:
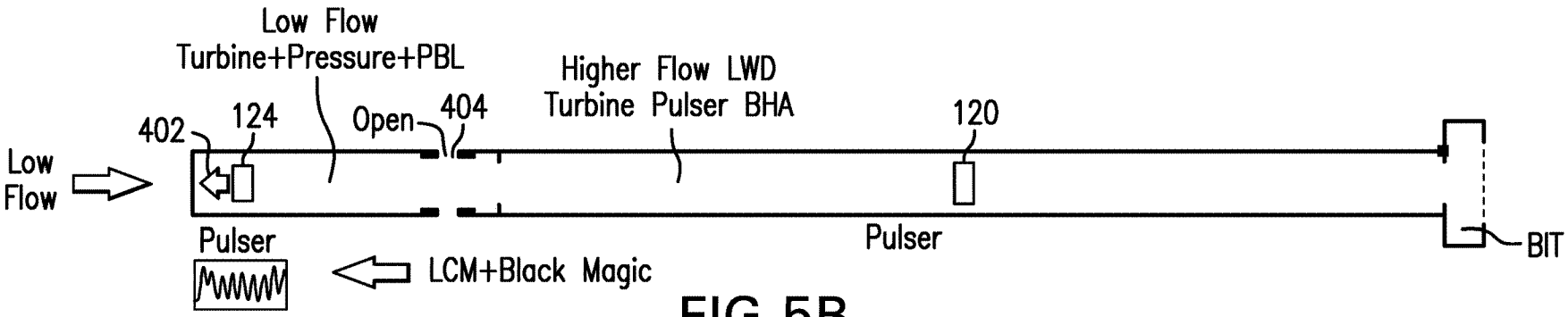

FIGS. 5A and 5B illustrate operation of the drill string 102 during a circulation blockage. FIG. 5A shows a condition in which the flow of the drilling fluid has been halted due to a circulation blockage. No information can be transmitted to the surface due to the lack of fluid circulation. In FIG. 5B, pressure modulation has been used to send (e.g. a flow-off downlink) a command to sub 304 in order to open ports 404, allowing for circulation of drilling fluid in the annulus above the BHA 302. The flow rate can then be maintained within the operating flow rate range of the auxiliary turbine generator 126 in order to supply power to the auxiliary pulser 124 to transmit data up hole via pulse 402.

Figure 6:
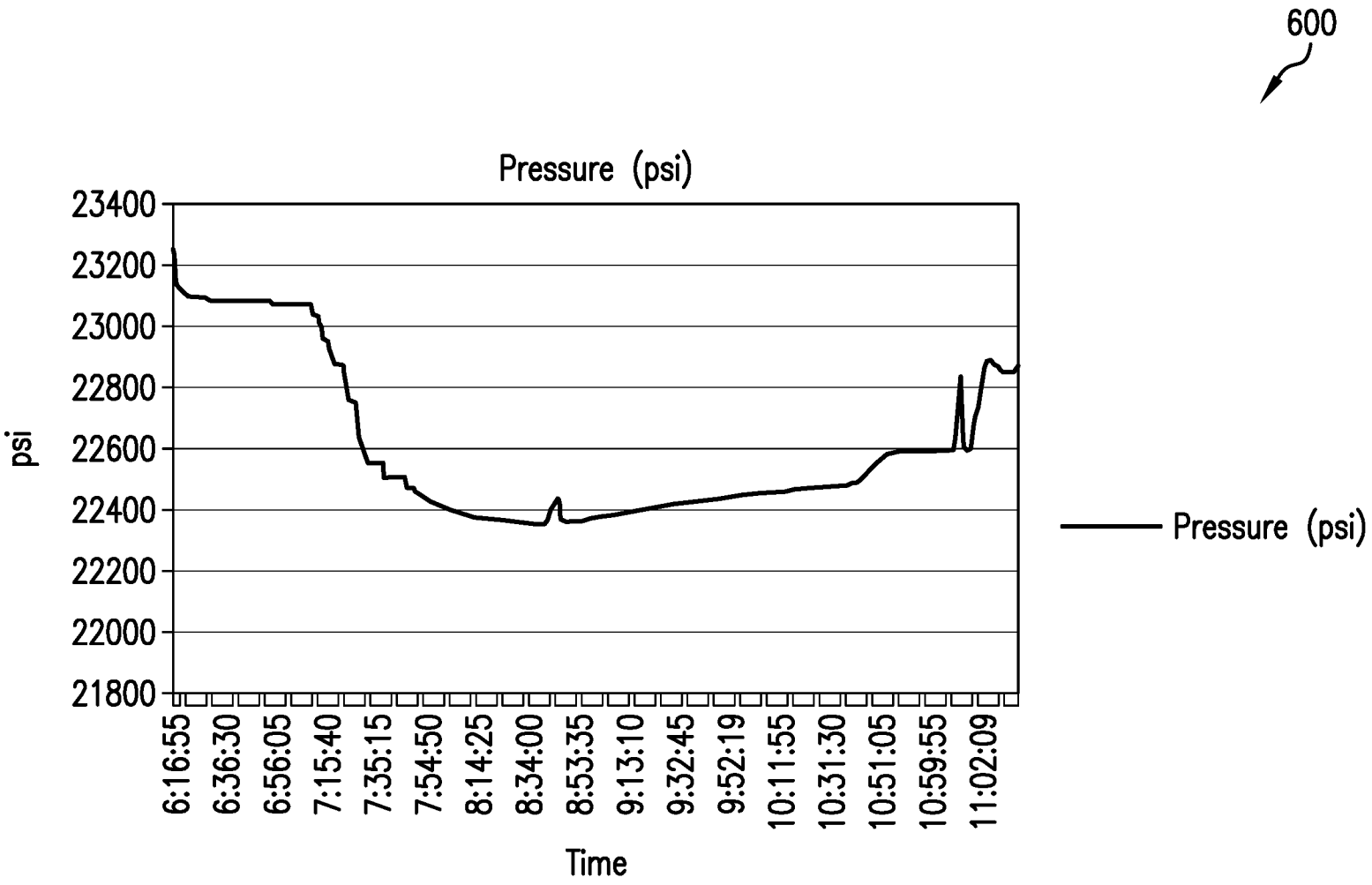
FIG. 6 shows a graph of pressure data telemetered to the surface in real-time using auxiliary puller during a fluid loss event.

FIG. 6 shows a graph 600 of pressure data telemetered to the surface in real-time using auxiliary pulser 124 during a fluid loss event. An initial drop in pressure at about 7:15:40 is gradually restored through LCM operations. The auxiliary pulser 124 is then activated and conveys (pressure pulses) the annular pressure data to the surface during the fluid loss event so that the operator can determine when the leakage in the formation has been addressed (at about 10:59:55) and when to increase the drilling fluid flow rate back to its normal operational flow rate range.

Figure 7:
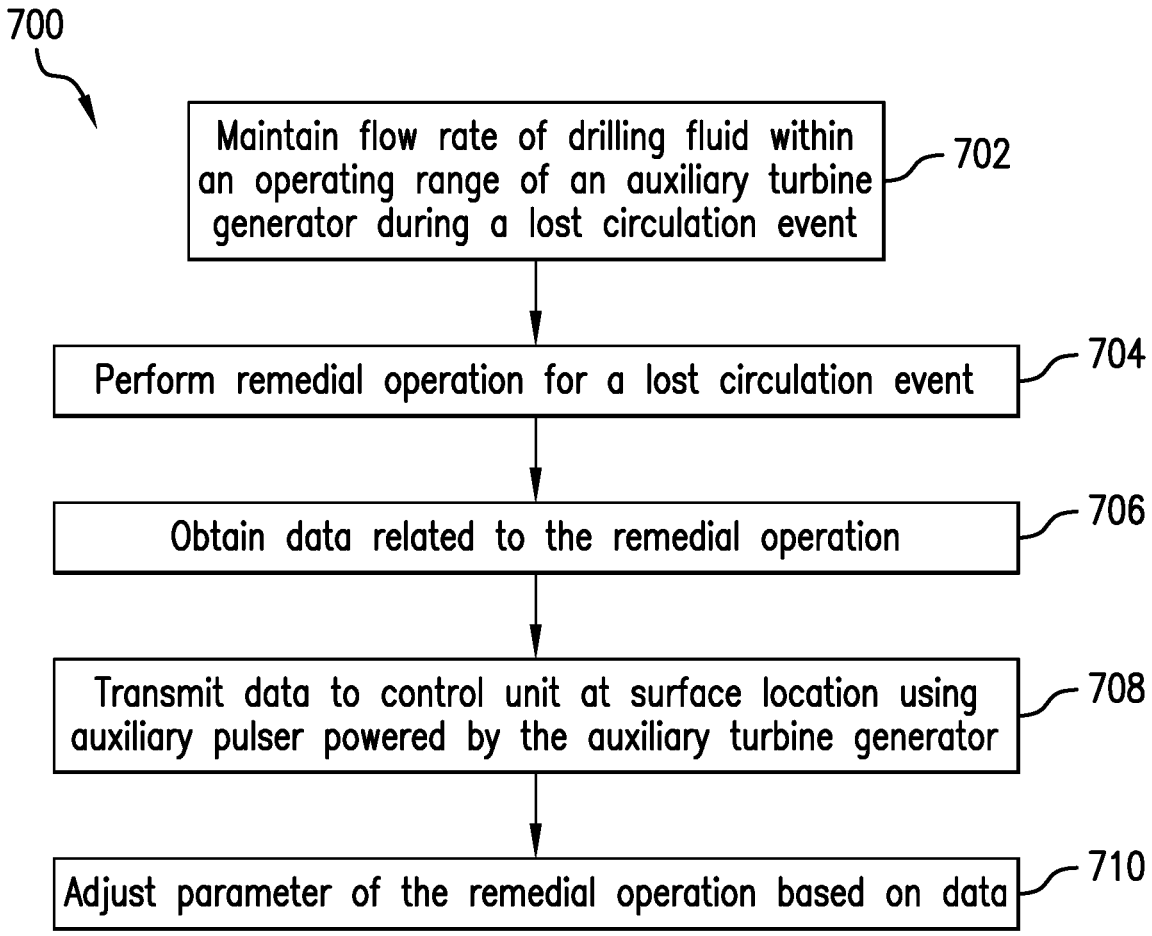
FIG. 7 shows a flowchart illustrating a method of using the drill string.

FIG. 7 shows a flowchart 700 illustrating a method of using the drill string. In box 702, the flow rate of the drilling fluid is lowered from a flow rate in an operating flow rate range of a main turbine generator to a flow rate in an operating flow rate range of auxiliary turbine generator 126. In box 704, an operation is performed downhole in order to remedy the lost circulation event. In box 706, a downhole device obtains data related to the lost circulation event. In various embodiments, the data can be an annular or inner bore pressure. In box 708, the auxiliary pulser transmits the data via the pressure sensor 148 to the control unit at the surface location. In box 701, the control unit changes a parameter of the remedial operation. In various embodiments, adjusting the parameter can include adjusting a flow path through the BHA, turning off the BHA or components of the BHA, opening the port in the sub 304, closing the port in the sub 304, etc. Such actions are generally performed using fluid modulation (downlink) while maintaining communication to the surface using power supplied by the auxiliary generator 126 and information supplied by the auxiliary pulser 124 (pressure pulse).

In various embodiments, drill string 102 includes a single pulser and the main turbine generator 122 and the auxiliary turbine generator 126 are used to power the single pulser.

The present invention therefore involves the addition of an auxiliary turbine powered device to a drilling assembly to power a subset of a bottom hole assembly which provides downhole to surface communications of parameters including but not limited to inner bore and annular pressure measurements. The auxiliary turbine is activated by fluid flow within a specified flow rate range below the flow rate range used by the main turbine generator for normal drilling operations. The auxiliary turbine can also be activated from surface using a timed pattern of bore pressure up, bore pressure down (pressure pulses) during no flow conditions where circulation blockage prevents the drilling fluid from flowing through either turbine. The pattern of pressure pulses includes digitally coded information (flow-off downlink). The pattern of pressure pulses is generated by a pressure actuator at surface. The pressure actuator can be hydraulic, pneumatic, electric, electro-hydraulic, piezoelectric, and electro-mechanical, in various embodiments. The pressure actuator is a device configured to reduce or increase the cross area of the standpipe and thereby reducing or increasing the fluid pressure in the standpipe and the inner bore of the drill string. In alternative embodiments, the pressure actuator connects the standpipe with a fluid volume with a higher pressure than in the standpipe. A battery-operated pressure sensor built into the BHA or sub 304 monitors pressure (inner bore pressure or annulus pressure) during circulation blockage events and is pre-programmed with a pressure downlink codex which is used to subsequently open a ported valve (or sliding sleeve) that fluidically connects the bore of the BHA to the annulus so that circulation can be reestablished. Once the ported annulus valve is opened, circulation can be reestablished at the lower flow rate range of the auxiliary turbine and the auxiliary turbine begins to power the BHA and auxiliary pulser and telemeter pressure and other information from the downhole bottom hole assembly while monitoring turbine revolutions per minute (RPM) by an RPM sensor in the auxiliary turbine alternator for detecting downlink commands sent through flow rate modulation from the surface. Alternatively, the output voltage of the auxiliary turbine alternator is monitored to detect the downlink. Various components which are electrically connected to the auxiliary turbine can be controlled using flow modulation from surface while simultaneously monitoring downhole pressure and other data and transmitting these data to surface using the auxiliary pulser. The auxiliary pulser may be tolerant to "Lost Circulation Material" (LCM) in the drilling fluid. Real time pressure monitoring using data from the auxiliary powered pulser continues (uplink) while remedial measures are taken during the "Lost Circulation Event". During fluid loss events, additional "Lost Circulation Material" are added to the drilling fluid and the pressure information from the auxiliary turbine powered bottom hole components are monitored until complete fluid circulation is reestablished at the surface. During pack off or stuck tool situations with blocked circulation, the auxiliary turbine powered BHA can be used to allow spotting fluids, designed to lubricate the stuck BHA to be pumped into the annulus of the BHA in an attempt to free the stuck BHA.

In alternative embodiments, the RPM of the turbine or the rotor of the generator and/or the temperature or the output voltage of the generator may be monitored by a controller located in the auxiliary and/or the main turbine generator. The RPM is monitored by a RPM sensor. The temperature is monitored by a temperature sensor. The voltage is monitored by a voltage meter. Based on the detected RPM, temperature and voltage a downhole controller may control which of the auxiliary and main turbine generator is providing energy to the BHA and the pulser (auxiliary pulser, main pulser or a single pulser). Depending on the flow rate range and the corresponding detected RPM, temperature and voltage, either the auxiliary turbine generator or the main turbine generator is used to provide power. The other of the auxiliary turbine generator and main turbine generator is shut down or becomes dormant. If the auxiliary turbine generator provides power to the auxiliary pulser or the single pulser and/or the BHA, then the main turbine generator does not provide power to the auxiliary pulser or the single pulser and/or the BHA. If the main turbine generator provides power to the main pulser or the single pulser and/or the BHA, then the main turbine generator does not provide power to the auxiliary pulser or the single pulser and/or the BHA.

In yet another embodiment a dual mud pulse transmission system may be used in a downhole isolation packer (DHIP) application. A DHIP is part of a BHA and is configured to shut-in the annulus and the inner bore of a downhole string in case of a formation fluid influx into the borehole (kick). If the inner bore or the annulus is closed, fluid circulation is no longer possible. The inner bore is closed by an inner bore sealing element (e.g. a string valve). The annulus is closed by an annulus sealing element (e.g. a packer element). Commonly, a DHIP is deployed together with a bypass valve located uphole of the inner bore sealing element and the annulus sealing element. The bypass valve allows fluid communication between the inner bore and the annulus. An auxiliary turbine generator located uphole of the inner bore sealing element and uphole of the bypass valve ensures power supply to the BHA as well as to an auxiliary pulser. The auxiliary pulser located uphole of the bypass valve. The auxiliary pulser provides communication through pressure pulses between the BHA and the surface while circulating fluid through the bypass valve. The main pulser may be located in the part of the BHA below the inner bore sealing element and is therefore disconnected from the fluid column to the surface. The main pulser is also outside the fluid circulation path through the bypass valve. The flow rate range of the auxiliary turbine generator is a flow rate range suitable for circulation through a bypass valve and is below a second flow rate range of the main turbine generator suitable for powering the BHA under normal drilling conditions. The auxiliary turbine generator can also be used to detect downlinks by monitoring the turbine RPM.

Set forth below are some embodiments of the foregoing disclosure:

Embodiment 1

A method to perform an operational action with a downhole system. The method includes conveying a downhole string of the downhole system into a wellbore, flowing a fluid through the downhole string at a first flow rate within a first flow rate range, generating electrical energy using a first turbine generator configured to generate electrical energy when the flow rate is within the first flow rate range, flowing the fluid at a second flow rate within a second flow rate range, generating electrical energy using a second turbine generator configured to generate electrical energy when the flow rate is within a second flow rate range different than the first flow rate range, transmitting a pressure pulse communicative of data generated downhole using a first pulser powered by one of the first turbine generator and the second turbine generator, receiving the pressure pulse at a sensor at a surface location, and performing an operational action based on the data communicated by the pressure pulses.

Embodiment 2

The method of any prior embodiment, wherein the operational action comprises one of opening and closing a fluid connection between an inner bore of the downhole string and an annulus between the downhole string and a wall of the wellbore, the fluid connection being located downhole the location of the first turbine generator and uphole of the location of the second turbine generator.

Embodiment 3

The method of any prior embodiment, wherein the first flow rate range is selected from one of: (i) from about 50 gallons per minute (gpm) to about 500 gpm; (ii) from about 70 gpm to about 400 gpm; (iii) from about 100 gpm to about 300 gpm; and (iv) from about 120 gpm to about 200 gpm.

Embodiment 4

The method of any prior embodiment, wherein the downhole string further includes a second pulser powered by the second turbine generator, the method further comprising increasing the flow rate through the downhole string from the first flow rate to the second flow rate to transmit a pressure pulse using the second pulser.

Embodiment 5

The method of any prior embodiment, wherein performing the operational action comprises transmitting a flow-off downlink.

Embodiment 6

The method of any prior embodiment, wherein one of: (i) the first flow rate range overlaps the second flow rate range; and (ii) a minimum value of the second flow rate range is greater than a maximum value of the first flow rate range.

Embodiment 7

The method of any prior embodiment, wherein the data is a parameter measured using a sensor located in the downhole string.

Embodiment 8

The method of any prior embodiment, further comprising flowing fluid through the fluid connection at a flow rate within the first flow rate range.

Embodiment 9

The method of any prior embodiment, wherein the data rate of the first pulser is lower than the data rate of the second pulser.

Embodiment 10

The method of any prior embodiment, further comprising monitoring one of a revolutions per minute and a voltage in the first turbine generator and shutting down the first turbine generator based on one of the monitored RPM and the monitored voltage.

Embodiment 11

A downhole system. The downhole system includes a downhole string having a flow channel therethrough, a first turbine generator configured to generate electrical energy when a flow rate of a fluid through the flow channel is within a first flow rate range, a second turbine generator configured to generate electrical energy when a flow rate of the fluid through the flow channel is within a second flow rate range, a first pulser at a downhole location in the downhole string, the first pulser operable to transmit a pressure pulse communicative of data generated downhole, using electrical energy generated by one of the first turbine generator and the second turbine generator, a sensor at a surface location receptive to the pressure pulse, and a control unit configured to perform an operational action based on the data communicated by the pressure pulse.

Embodiment 12

The system of any prior embodiment, f wherein the operational action comprises one of opening and closing a fluid connection between an inner bore of the downhole string and an annulus between the downhole string and a wall of the wellbore, the fluid connection being located downhole the location of the first turbine generator and uphole of the location of the second turbine generator.

Embodiment 13

The system of any prior embodiment, wherein the first flow rate range is selected from one of: (i) from about 50 gallons per minute (gpm) to about 500 gpm; (ii) from about 70 gpm to about 400 gpm; (iii) from about 100 gpm to about 300 gpm; and (iv) from about 120 gpm to about 200 gpm.

Embodiment 14

The system of any prior embodiment, further comprising a second pulser powered by the second turbine generator.

Embodiment 15

The system of any prior embodiment, wherein the operational action comprises transmitting a flow-off downlink.

Embodiment 16

The system of any prior embodiment, wherein one of: (i) the first flow rate range overlaps the second flow rate range; and (ii) a minimum value of the second flow rate range is greater than a maximum value of the first flow rate range.

Embodiment 17

The system of any prior embodiment, wherein the data is a parameter measured using a sensor located in the downhole string.

Embodiment 18

The system of any prior embodiment, further comprising a controller monitoring one of a revolutions per minute (RPM) and a voltage in the first turbine generator, the controller shutting down the first turbine generator based on one of the monitored RPM and the monitored voltage.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

It is understood that the term "above" as used herein refers to being closer to a surface location and the term "below" refers to being further away from a surface location. Thus, an element A that is "above" element B is closer to the surface than element B and an element C that is "below" of element B is further from the surface then element B. Similarly, an element A that is "uphole" of element B is closer to the surface than element B and an element C that is "downhole" of element B is further from the surface then element B. The term surface location in this disclosure refers to a location outside the wellbore and at or above the surface of the earth.

What is claimed is:

1. A method of performing an operational action with a downhole system, the method comprising:

conveying a downhole string of the downhole system into a wellbore;

flowing a fluid through the downhole string at a first flow rate within a first flow rate range;

generating electrical energy using a first turbine generator configured to generate electrical energy when the flow rate is within the first flow rate range;

flowing the fluid at a second flow rate within a second flow rate range;

generating electrical energy using a second turbine generator configured to generate electrical energy when the flow rate is within the second flow rate range different than the first flow rate range;

transmitting a pressure pulse communicative of data generated downhole using a first pulser powered by one of the first turbine generator and the second turbine generator;

receiving the pressure pulse at a sensor at a surface location;

performing an operational action based on the data communicated by the pressure pulse; and wherein the downhole string further includes a second pulser powered by the second turbine generator, the method further comprising increasing the flow rate through the downhole string from the first flow rate to the second flow rate to transmit a pressure pulse using the second pulser.

2. The method of claim 1, wherein the operational action comprises one of opening and closing a fluid connection between an inner bore of the downhole string and an annulus between the downhole string and a wall of the wellbore, the fluid connection being located downhole the location of the first turbine generator and uphole of the location of the second turbine generator, the fluid connection allowing the fluid to flow from the inner bore to the annulus to flow to an uphole location.

3. The method of claim 1, wherein one of: (i) the first flow rate range overlaps the second flow rate range; and (ii) a minimum value of the second flow rate range is greater than a maximum value of the first flow rate range.

4. The method of claim 1, wherein the data rate of the first pulser is lower than the data rate of the second pulser.

5. The method of claim 1, wherein performing the operational action comprises transmitting a flow-off downlink.

6. The method of claim 1, further comprising monitoring one of a revolutions per minute and a voltage in the first turbine generator and shutting down the first turbine generator based on one of the monitored RPM and the monitored voltage.

7. The method of claim 1, further comprising one of: (i) a gear in at least one of the first turbine generator and the second turbine generator and (ii) an energy consumer operationally connected to at least one of the first turbine generator and the second turbine generator.

8. The method of claim 1, wherein the data is a parameter measured using a sensor located in the downhole string.

9. A method of performing an operational action with a downhole system, the method comprising:

conveying a downhole string of the downhole system into a wellbore;

flowing a fluid through the downhole string at a first flow rate within a first flow rate range;

generating electrical energy using a first turbine generator configured to generate electrical energy when the flow rate is within the first flow rate range;

flowing the fluid at a second flow rate within a second flow rate range;

generating electrical energy using a second turbine generator configured to generate electrical energy when the flow rate is within a second flow rate range different than the first flow rate range;

transmitting a pressure pulse communicative of data generated downhole using a first pulser powered by one of the first turbine generator and the second turbine generator;

receiving the pressure pulse at a sensor at a surface location;

performing an operational action based on the data communicated by the pressure pulse; and wherein the operational action comprises one of opening and closing a fluid connection between an inner bore of the downhole string and an annulus between the downhole string and a wall of the wellbore, the fluid connection being located downhole the location of the first turbine generator and uphole of the location of the second turbine generator, the fluid connection allowing the fluid to flow from the inner bore to the annulus to flow to an uphole location.

10. The method of claim 9, wherein the data is a parameter measured using a sensor located in the downhole string.

11. The method of claim 9, further comprising flowing fluid through the fluid connection at a flow rate within the first flow rate range.

12. The method of claim 9, wherein performing the operational action comprises transmitting a flow-off downlink.

13. The method of claim 9, further comprising monitoring one of a revolutions per minute (RPM) and a voltage in the first turbine generator and shutting down the first turbine generator based on one of the monitored RPM and the monitored voltage.

14. The method of claim 9, further comprising a second pulser powered by the second turbine generator.

15. A downhole system, comprising:

a downhole string in a wellbore having a flow channel therethrough;

a first turbine generator configured to generate electrical energy when a flow rate of a fluid through the flow channel is within a first flow rate range;

a second turbine generator configured to generate electrical energy when a flow rate of the fluid through the flow channel is within a second flow rate range different than the first flow rate range;

a first pulser at a downhole location in the downhole string, the first pulser operable to transmit a pressure pulse communicative of data generated downhole, using electrical energy generated by one of the first turbine generator and the second turbine generator;

a sensor at a surface location receptive to the pressure pulse;

a fluid connection between an inner bore of the downhole string and an annulus between the downhole string and a wall of the wellbore, the fluid connection being located downhole of the location of the first turbine generator and uphole of the location of the second turbine generator, the fluid connection allowing the fluid to flow from the inner bore to the annulus to flow to an uphole location; and a control unit configured to perform an operational action based on the data communicated by the pressure pulse.

16. The downhole system of claim 15, wherein the operational action comprises one of opening and closing the fluid connection.

17. The downhole system of claim 15, further comprising a second pulser powered by the second turbine generator.

18. The downhole system of claim 15, wherein the operational action comprises transmitting a flow-off downlink.

19. The downhole system of claim 15, wherein one of: (i) the first flow rate range overlaps the second flow rate range; and (ii) a minimum value of the second flow rate range is greater than a maximum value of the first flow rate range.

* * * * *